US009492706B1

(12) United States Patent
Turnbow

(10) Patent No.: US 9,492,706 B1
(45) Date of Patent: Nov. 15, 2016

(54) METHOD AND PORTABLE APPARATUS FOR EXERCISING THE UPPER EXTREMITIES

(71) Applicant: Cody Turnbow, Capitan, NM (US)

(72) Inventor: Cody Turnbow, Capitan, NM (US)

(73) Assignee: STUCK OUTSIDE THE BOX CONSULTING, LLC, Capitan, NM (US)

( * ) Notice: Subject to any disclaimer, the term of this patent is extended or adjusted under 35 U.S.C. 154(b) by 0 days.

(21) Appl. No.: 14/577,377

(22) Filed: Dec. 19, 2014

Related U.S. Application Data

(60) Provisional application No. 61/919,639, filed on Dec. 20, 2013.

(51) Int. Cl.
*A63B 23/00* (2006.01)
*A63B 23/035* (2006.01)
*A63B 21/00* (2006.01)

(52) U.S. Cl.
CPC ... *A63B 23/03541* (2013.01); *A63B 21/00127* (2013.01)

(58) Field of Classification Search
CPC ..... A63B 21/015; A63B 21/28–21/285; A63B 21/4035; A63B 21/4049; A63B 22/0002–22/0005; A63B 23/03516–23/03541
See application file for complete search history.

(56) References Cited

U.S. PATENT DOCUMENTS

| | | | | |
|---|---|---|---|---|
| 3,062,543 | A * | 11/1962 | Shaboo | A63B 21/0004 403/107 |
| 3,588,102 | A | 6/1971 | Gifford | |
| 4,531,729 | A | 7/1985 | Wrinkle | |
| 6,217,494 | B1 | 4/2001 | Sandoval | |
| 6,306,064 | B2 | 10/2001 | Globus | |
| 7,614,984 | B1 * | 11/2009 | Krull | A63B 21/0004 482/131 |
| 2003/0092536 | A1 | 5/2003 | Romanelli et al. | |

FOREIGN PATENT DOCUMENTS

| | | |
|---|---|---|
| GB | 2464100 A | 4/2010 |
| JP | 11-164910 A | 6/1999 |

* cited by examiner

*Primary Examiner* — Oren Ginsberg
*Assistant Examiner* — Jennifer M Deichl
(74) *Attorney, Agent, or Firm* — Rod D. Baker

(57) ABSTRACT

A method and apparatus for exercising the upper portions of the human body. The apparatus is a "zigzag" configured rod that has rotatable grips on three parallel sections of thereof. The apparatus preferably can alternatively be configured or re-configured in a U-shape. A user, with or without the assistance of another person grasps two of the grips and rotates the device around its central section to perform a wide variety of exercises. A method is provided for using the apparatus to perform exercises beneficial for the user's arms and upper body.

13 Claims, 9 Drawing Sheets

METHOD AND PORTABLE APPARATUS FOR EXERCISING THE UPPER EXTREMITIES

CROSS-REFERENCE TO RELATED APPLICATIONS

This application claims the benefit of the filing of U.S. Provisional Patent App. Ser. No. 61/919,639 filed 20 Dec. 2013 and entitled "Method and Portable Apparatus for Exercising the Upper Extremities," the entire specification of which is incorporated herein by reference.

BACKGROUND OF THE INVENTION

Field of the Invention

The invention relates generally to methods of exercise and exercising apparatuses, particularly apparatuses and methods for exercising a person's upper body, and specifically to a therapeutic apparatus and method for exercising the arms and upper body.

Background Art

It is known to provide devices for exercising a person's upper body. Examples of known devices in this field of endeavor include those disclosed in U.S. Pat. No. 3,588,102; U.S. Pat. No. 6,306,064; U.S. Patent Application Publication No. US 2003/0092536; U.S. Pat. No. 6,217,494; and U.S. Pat. No. 4,531,729. The known devices, however, generally suffer from drawbacks due to complexity, lack of versatility, and lack of portability.

SUMMARY OF THE DISCLOSURE

There is disclosed an upper-body exercise apparatus and methods for using the apparatus. The apparatus is simple to make and use, and is advantageously portable and versatile. The apparatus may be fabricated, for example, from rigid metal, plastic, or composite tubing. The apparatus has two principal components that are mutually engagable in either of two configurations, depending upon the type of exercise sought to be performed. A base portion is temporarily and releasably connectible to an extension portion. The base portion and the extension portion may be connected in a very general zig-zag configuration to be manipulated manually in a manner somewhat similar to the pedaling of a bicycle. The base portion and the extension portion can then be disconnected and then reconnected in a generally U-shaped configuration to be manipulated manually in a manner somewhat suggestive of two-handed rowing or cranking motion. The apparatus configuration thus can be selectively switched back and forth between the pedal configuration and the crank configuration. The apparatus includes two or three grips rotatably mounted upon selected portions of the base and extension portions. The invention includes a methods of using the apparatus by grasping it in a variety of manners and revolving it about itself in one or more positions and orientation in space relative to the user's body. The method includes revolving the apparatus around itself while maintaining it in a single orientation, as well as revolving it around itself while also moving its position relative to the user. The method includes use of the apparatus by two users.

BRIEF DESCRIPTION OF THE DRAWINGS

The attached drawings, which form part of the disclosure, are as follows.

DESCRIPTION OF A PREFERRED EMBODIMENT

There is disclosed hereby a method and apparatus for exercising the upper portions of the human body. Succinctly described, the apparatus of the invention includes a "zigzag" configured rod that has rotatable grips on three parallel sections of thereof. In a preferred embodiment, the apparatus can alternatively be configured or re-configured in a U-shape. The user, with or without the assistance of another person (who would grasp the central grip), grasps two "end" grips and rotates the device around its central section to perform a wide variety of exercises. The exercises are beneficial for the arms and upper body.

The apparatus according to the invention is portable, and is contemplated for use in lieu of conventional known upper extremity "bike" type devices. The apparatus is light weight and easily transported. The apparatus offers beneficial versatility of use to permit a wide variety of range of motion (ROM) exercises for strengthening and endurance, promoting variety of methods of use. Previous known devices in the general field of endeavor involve bicycle-pedal-like cranks that are rotatably mounted in a cumbersome frame, which is then secured (often temporarily) to a table top or other supporting surface. An advantage of the present system is its portability and versatility compared to frame-mounted devices.

With most upper extremity bikes the patient-use holds onto the pedals and then rotates the pedals either forward or reverse to move his or her arms in fixed-location circles. The presently disclosed apparatus is an improved alternative because, among other benefits, it better works a patient's strength and endurance; users of known upper extremity bikes can simply hold on and "go through the motions." Also, it need not be mounted upon a table or other surface.

Figure 1:
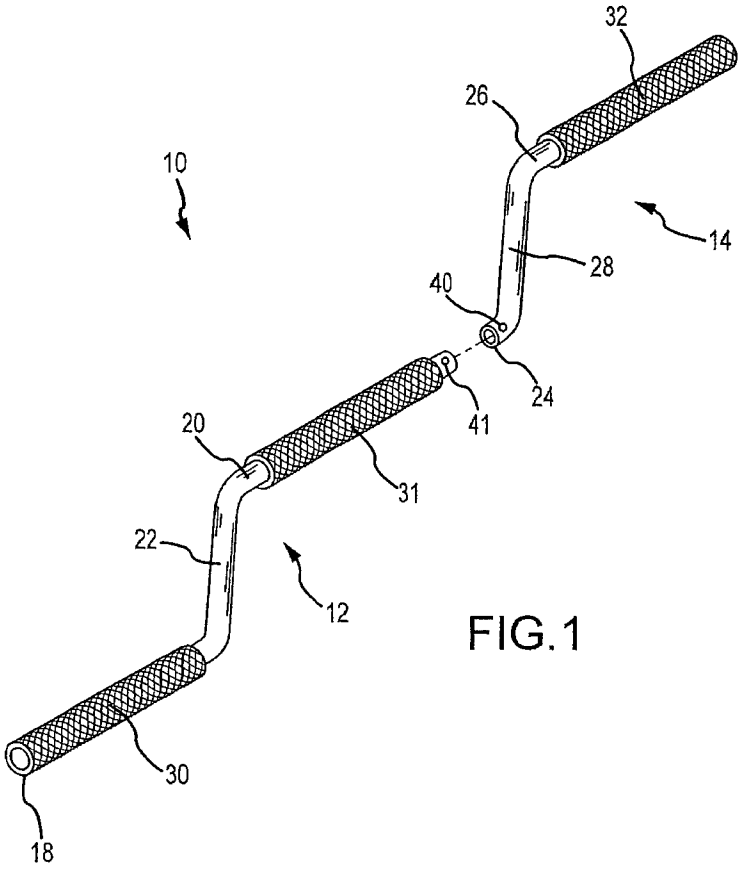
FIG. 1 is a perspective exploded view of a preferred apparatus of the present invention.

Attention is invited to FIG. 1, showing the upper extremity exerciser apparatus 10. The principal components of the apparatus may be fabricated from any suitable lightweight, durable, material, such as fabricated tubes or rods of plastic, polymer composite, aluminum alloy, or the like. As seen in FIG. 1, the apparatus 10 preferably includes a base portion 12 and an extension portion 14. Each portion 12, 14, may be fabricated from lightweight tubes (or alternatively, solid rods) in the general configurations shown; the tubes may have, for example, a diameter of from about 1.2 cm to about 3.0 cm, preferably about 1.3 cm (0.5 inch). When assembled for use, the apparatus 10 has an overall length (i.e., from side-to-side as seen in FIGS. 3 and 4) of from about 38 cm (15 inches) to about 56 cm (22 inches), although this is by way of preferred example rather than by way of limitation.

Figure 3:
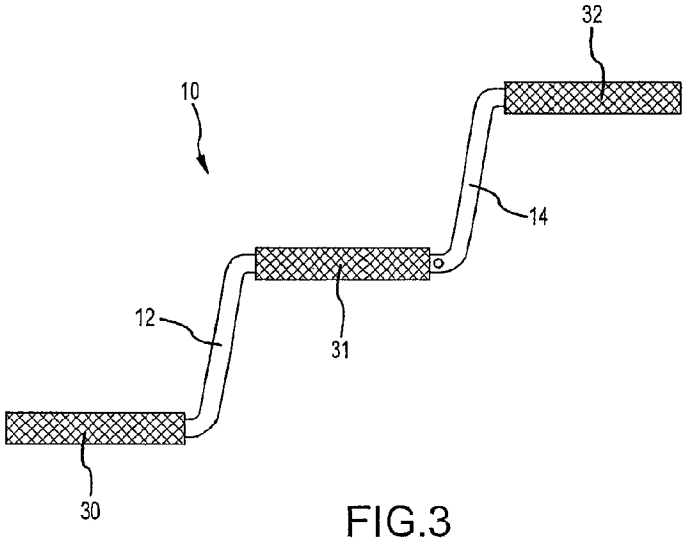
FIG. 3 is a front view of a preferred embodiment of the apparatus assembled for use in a zig-zag shaped "pedal configuration" configuration.
Figure 4:
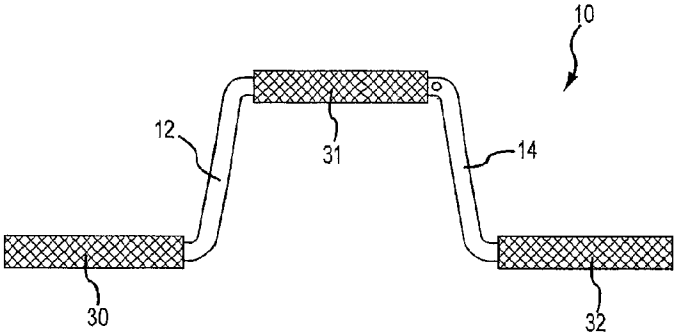
FIG. 4 is a front view of a preferred embodiment of the apparatus assembled for use in an alternative, U-shaped, "crank configuration" configuration.

In its simplest version, the apparatus 10 is configured solely in the zig-zag pedal configuration seen in FIG. 3. In such an embodiment, the base portion 12 and the extension portion 14 are integrated into one unit, i.e., they are fabricated separately but are then permanently secured together or, alternatively, are fabricated unitarily such as from a single bent/molded/formed rod or tube. But preferably, the base portion 12 and the extension portion 14 are releasably connected together to permit their disengagement and re-engagement into the U-shaped crank configuration depicted in FIG. 4.

Figure 2:
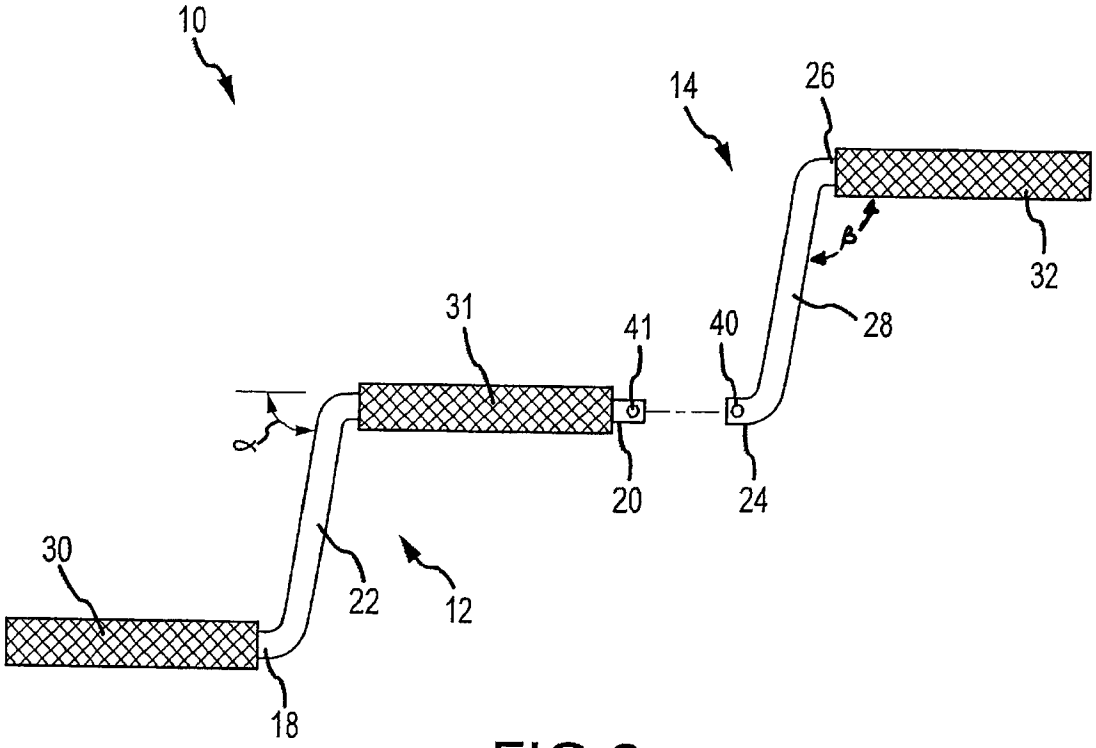
FIG. 2 is front exploded view of a preferred apparatus of the present invention.

Referring to FIGS. 1 and 2, the base portion 12 has an outer base portion 18 and an inner base portion 20 joined by an angled intermediate base portion 22. The three base portions 18, 20, 22 preferably are integrated, as fabricated from a molded or bent rod or tube, but alternatively could be assembled (e.g., by welding adhesives, or the like) from component parts. The extension portion 14 similarly has a relatively abbreviated inner extension portion 24 joined to an outer extension portion 26 by an angled intermediate extension portion 28. The extension portion 14 also preferably is integral, such as a single segment of rigid pipe or tube bent or molded into the shape indicated.

There is a generally cylindrically tubular left hand grip 30 rotatably mounted upon the outer base portion 18, and a cylindrically tubular middle hand grip 31 rotatably mounted upon the base inner portion 20. A similar right hand grip 32 is mounted for rotation upon the outer extension portion 26. Any means known in the art for providing coaxial rotation, while preferably limiting axial shifting, may be used. Separate ball bearing or bushing assemblies may be provided, or there may simply be provided between each grip 30, 31, 32 and its respective base or extension portion (18, 20, 26) a long-lasting lubrication and/or a slippery sleeve element (e.g. a TEFLON® sleeve or the like). Regardless of the selected means for providing the connection between each hand grip 30, 31, 32 and its respective base or extension portion, each grip closely surrounds circumferentially its respective base or extension portion, and is free to rotate coaxially around it with minimal axial/longitudinal shifting of the grip relative to its supporting portion. The grips 30, 31, 32 are adapted to be grasped by a user's hand, and thus preferably have an axial length slightly greater than the lateral width of a grasping human hand (e.g. about 11 cm (about 4.5 inches)). The axial length of each base and extension portion 18, 20, 26 that mounts a grip 30, 31, 32 accordingly is at least as long as its corresponding hand grip. The grips 30, 31, 32 are provided with exterior gripping surfaces composed of any suitable composition known in the art for providing a comfortable and reliable (non-slip) contact with a user's grasping hand. Grips 30, 31, 32 may each have an outside diameter of, say, between about 2.0 cm (about 0.75 inch) and about 4.0 cm (about 1.5 inches). Tubular grips typically have inside diameters just larger than the outside diameter of the corresponding base or extension portion, but to allow the provision of rotary connection means radially between the grip and base/extension portion as needed.

Attention is invited to FIGS. 2-4, especially FIG. 2. The base portion 12 is configured such that the intersecting axes of the base intermediate portion 22 and base inner portion 20 define an included angle $\alpha$ (alpha). Likewise, although not expressly labeled in FIG. 2, the extension portion 14 is shaped so that the intersecting axes of the extension intermediate portion 28 and extension outer portion 26 also define an angle. Very preferably, but not necessarily, the intersecting axes of the extension intermediate portion 28 and the extension outer portion 26 define an angle equal to angle $\alpha$, that is, substantially equal to the angle defined between the base intermediate portion 22 and base inner portion 20. The base portion 12 is so shaped that the axis of the base outer portion 18 is substantially parallel to the axis of the base inner portion 20 (although these portions are axially offset from one another by the conjoined base intermediate portion 22). Similarly, the extension portion 14 is so shaped that the axis of the extension outer portion 26 is substantially parallel to the axis of the short stub of the extension inner portion 24. Accordingly, an angle $\beta$ defined between the base outer portion 18 and the base intermediate portion 22 can be characterized as supplementary to the angle $\alpha$ (i.e., $\beta=180°-\alpha$), and the angle defined between the extension inner portion 24 and the extension intermediate portion 28 likewise can also be characterized as supplementary to angle $\alpha$. In a preferred embodiment of the apparatus, angle $\alpha$ preferably is between 75° and 85°, and most preferably is about 80° (i.e., angle $\beta$ preferably is about 100°). Notwithstanding the foregoing, simple embodiments of the apparatus may feature an angle $\alpha$ of approximately 90°. Thus, the portions of the apparatus 10 optionally may define only right angles between the intermediate portions 22, 28 and their respective outer and inner portions 18, 20 and 24, 26.

FIGS. 1 and 2 are exploded views of apparatus 10 to show that the base portion 12 is releasably engageable with the extension portion 14. While temporarily engaged and interconnected for use, the base portion 12 and the extension portion 14 are immobile in relation to each other, and function as a single unit. The extension inner portion 24 is temporarily connectable, for example by a telescopic insertion, with the base inner portion 20. The connection between the base portion 12 and extension portion 14 is by any suitable temporary, releasable connection mode known in the art for attaching/detaching the free ends of tubes or rods. For example, connection may be by means of a well-known spring-loaded detent or catch assembly; one or two spring-biased connection buttons 40 may be disposed on the extension inner portion 24 for engagement into a pair of connection holes 41 defined at appropriate places in the free end of the base inner portion 20. Only one connection hole 41 is seen in the drawing figures; a second hole preferably is defined in the base inner portion diametrically opposite from the hole seen in the drawing, to permit the extension portion 14 to be connected with the base portion 12 in either of two relative positions, as to be explained further herein. The extension inner portion 24 is insertable into the open end of the base inner portion 20, which induces the refraction of the connection button(s) against the bias of their spring(s); when the button(s) 40 are in registration with the connection holes 41, the buttons are urged into the connection holes by the action of spring bias to provide a releasable junction of the extension portion 14 with the base portion 12. Manual depression of the buttons against the spring bias allows the extension portion to be disconnected from the base portion 12.

Combined reference to FIGS. 1-4 shows that the apparatus 10 can be selectively arranged in either of two working configurations. By detaching and reattaching the extension inner portion 24 from and to the base inner portion 20, the relative positions of the base portion 12 and extension portion 14 can be adjusted. FIG. 3 depicts the apparatus 10 in the zig-zag "pedal configuration," while FIG. 4 shows the apparatus configured in the U-shaped "crank configuration."

In the pedal configuration of FIG. 3, the respective axes of the base outer portion 18, the base inner portion 20, and the extension outer portion 26 are mutually parallel, but no two of these have their axes aligned; only the base inner portion 20 and the extension inner portion 24 are in coaxial registration with their axes aligned. In contrast, when the apparatus 10 is in the crank configuration seen in FIG. 4, the axis of the base inner portion 20 is parallel to the extension outer portion 26, and the axis of the base outer portion 18 is aligned with the axis of the extension outer portion 26, while the base inner portion 20 and the extension inner portion 24 also are coaxially connected.

Referring to FIGS. 2-4, it is seen that the apparatus 10 thus can be switched back and forth between the pedal configuration and the crank configuration. If the apparatus 10 initially is in the pedal configuration of FIG. 3, the extension portion 14 simply can be disconnected from the base portion 12, rotated 180 degrees, and re-connected to the base portion to arrange the apparatus in the crank position of FIG. 4. In a preferred embodiment, therefore, the means for releasably connecting the free end of the extension inner portion 24 to the free end of the base inner portion 20 permits the extension portion 14 to be connected to the base portion 12 in either of the respective two use configurations of FIGS. 3 and 4, and then be disconnected and then reconnected in the other use position.

A significant advantage of the apparatus is its versatility of use. The apparatus 10 is used in either the pedal configuration or the crank configuration. If desired, a patient-user can readily switch back and forth between these configurations during the course of a single exercise or therapy session. Furthermore, the apparatus is adapted for use either by a single user alone, or by a patient in cooperative use with a physical therapist or assistant. Because the apparatus 10 need not and is not encumbered by any frame or support components, it can be placed in nearly any position, relative to the user(s) bodies, for use. And the apparatus 10 can be situated in practically any orientation in three-dimensional space for use. The methodological versatility provided is thus nearly limitless.

Figure 6:
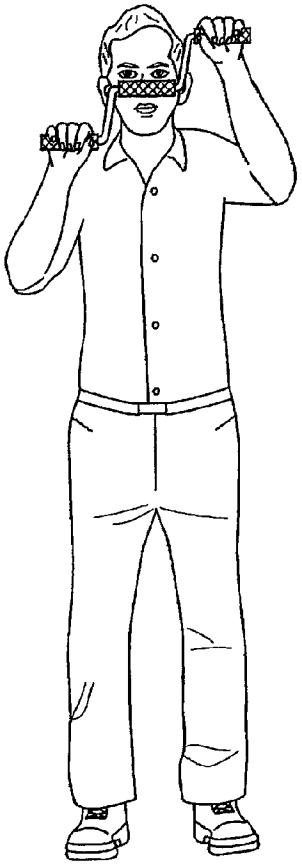
FIG. 6 is a front view of a user in a position to operate a pedal-configured apparatus to practice a "horizontal upper-center" method of the present invention.
Figure 5:
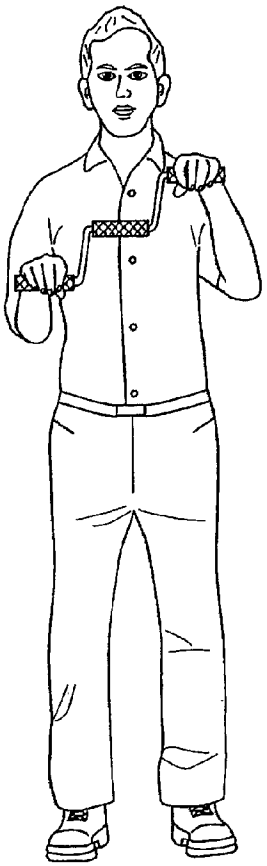
FIG. 5 is a front view of a user in a position to operate a pedal-configured apparatus to practice a "horizontal mid-center" method of the present invention.
Figure 7:
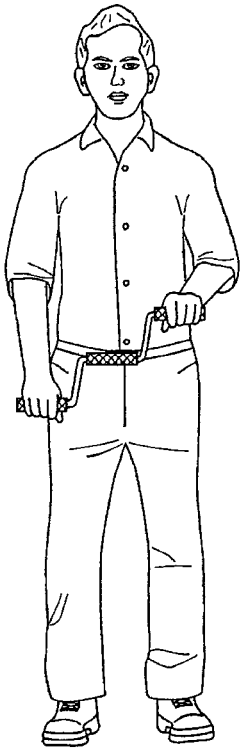
FIG. 7 is a is a front view of a user in a position to operate a pedal-configured apparatus to practice a "horizontal lower-center" method of the present invention.

Attention is invited to FIGS. 5-7, showing a user utilizing the upper extremity exerciser apparatus 10 to execute a variety of upper extremity exercises. FIGS. 5-7 illustrate the apparatus 10 assembled and used in the "pedal configuration." The user is depicted in a standing position, but it is noted that he alternatively could be seated, kneeling, crouching, or even lying on his back, etc. The user holds the apparatus 10 by grasping the grips 30 and 32. With his arms in front and palms facing generally down, the user pedals the apparatus by revolving the respectively offset axes of the base outer portion 18 and of the extension outer portion 26 around the central co-axis of the inner portions 20, 24. The revolutions can be in either direction (forward and backward, i.e., clockwise or counterclockwise about the axes of the inner portions 20, 24), and the direction of revolution can be in one direction only, or can be repeatedly reversed.

Additionally, it is to be understood that while the drawing figures show the user practicing methods while his palms/wrists are facing downward, the user's grasp upon either or both grips 30 and/or 32 can be with the palm(s)/wrist(s) facing upward; with the knuckles of either or both hand thus directed upward, the character of the user's grasp is altered subtly, modestly but significantly altering the character of her muscular activity and broadening the workout. The type of grasp (upper- or lower-facing) can be changed or alternated during a workout session, and for either or both hands. Such a method of use works on the range of motion for the user's joints in the wrists, elbows, shoulders, and shoulder girdle, and strengthens associated muscle groups. During this "horizontal mid-center" method of use illustrated in FIG. 5, the co-axis of the inner portions 20, 24 is held generally horizontal (e.g., parallel to the floor), and may be maintained in a single position in space for a selected interval of time. In FIG. 5, the apparatus 10 is held at about the height of the user's bust/chest.

Significantly, the user can also perform similar "pedaling" exercises closely related to that described immediately above, but with the apparatus 10 moved to a different location in space. For example, with the co-axis of the inner portions 20, 24 maintained generally horizontal, the user may practice the "horizontal upper-center" method of use shown in FIG. 6. The user of this method also pedals (in either rotary direction) the apparatus by revolving the axes of the base outer portion 18 and the extension outer portion 26 around the co-axis of the inner portions 20, 24; in this version of the method of use, the co-axis of the inner portions 20, 24 is held at, for example, about the height of the user's face, although it could be held even higher. For example, the versatility of the invention permits the user to tip his head forward, and to situate the apparatus above and slightly behind his head to "pedal" it at that location, to work yet a different collection of joints and muscles. This practice improves the range of motion for the user's joints in the wrists, elbows, shoulders, and shoulder girdle, and strengthens associated muscle groups. However, owing to the fact that the apparatus 10 is held at a height relatively greater than that seen in FIG. 5, the joints, muscles, and muscle groups/pairs are subjected, collectively as well as individually, to a "horizontal upper-center" workout different in type and degree to the workout received by using the apparatus 10 in the horizontal mid-center method of FIG. 5.

In a similar mode, the co-axis of the inner portions 20, 24 can be held horizontal and lowered to practice a "horizontal lower-center" method of use shown in FIG. 7. The user of this method also pedals (in either rotary direction (clockwise and/or counterclockwise)) the apparatus by revolving the axes of the base outer portion 18 and extension outer portion 26 around the central co-axis of the inner portions 20, 24. The co-axis of the inner portions 20, 24 is held at, for example, about the height of the user's waist, although it could be held even lower. Again, this practice improves the range of motion for the user's joints in the wrists, elbows, shoulders, and shoulder girdle, and strengthens associated muscle groups. However, owing to the fact that the apparatus 10 is held at a height relatively greater than that seen in FIG. 5, the joints, muscles, and muscle groups/pairs are subjected, collectively as well as individually, to a "horizontal lower-center" workout different in type as well as degree to the workout received by using the apparatus 10 in either of the methodologies of FIG. 5 or 6.

The method of the invention includes moving the apparatus 10 amongst and between the various spatial positions seen in FIGS. 5-7. Thus the user, while continuously pedaling the apparatus and substantially maintaining the horizontally of the co-axis of the inner portions 20, 24, may move the apparatus 10 in front of her torso in an up-and-down manner. While the revolving of the outer portions 18, 26 is continued, the user can translate the apparatus alternately between the horizontal upper-center position (FIG. 6) and the horizontal lower-center position (FIG. 7), or between any number of intermediate height positions.

Figure 8:
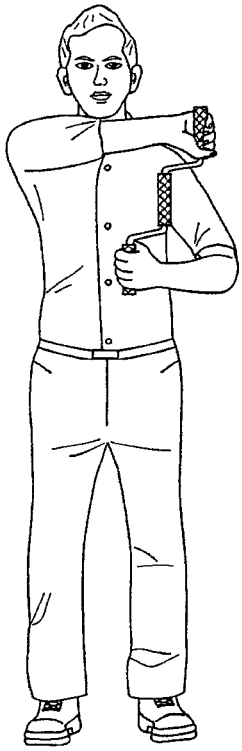
FIG. 8 is a front view of a user in a position to operate a pedal-configured apparatus to practice a "vertical mid-left" method of the present invention.

The method according to the invention includes operating the apparatus 10, in the pedal configuration, while the co-axis of the inner portions 20, 24 is oriented substantially vertically. Referring to FIG. 8, the user is depicted in a standing position; it is again noted that he alternatively could be seated, kneeling, crouching, etc. FIG. 8 shows a "vertical mid-left" method of use, with the central co-axis maintained toward the left side of the user's torso. The user holds the apparatus 10 by grasping the grips 30 and 32. With his arms in front of his torso and with his lower arms (i.e., radius and ulna bones) approximately parallel to the floor/ground, the user pedals the apparatus—again by revolving the respectively offset axes of the base outer portion 18 and of the extension outer portion 26 around the central co-axis defined by the inner portions 20, 24. As seen in FIG. 8, the co-axis of the connected inner portions 20, 24 is oriented substantially vertically (i.e., if the user is standing or seated), while the vertically oriented, but laterally offset, axes of the outer portions 18, 26 revolve around the central co-axis. And again, the revolutions can be in either direction (forward and backward, i.e., clockwise or counterclockwise about the axes of the inner portions 20, 24). The direction of revolution can be in one direction only, or can be repeatedly reversed. Such a method of use works on the range of motion for the user's joints in the wrists, elbows, shoulders, and shoulder girdle, and strengthens associated muscle groups. During the "vertical mid-left" method of use illustrated in FIG. 8, the co-axis of the inner portions 20, 24 is held generally vertical (e.g., perpendicular to the floor) and may be maintained in a single position in space for a selected or predetermined and measured interval of time. In FIG. 8, the apparatus 10 is held at about the height of the user's chest, toward the left side of the user's torso.

Significantly, the user can also perform similar "pedaling" exercises closely related to that described immediately above, but with the apparatus 10 moved to a different location in space. For example, with the co-axis of the inner portions 20, 24 maintained generally vertical, the user may practice the "vertical mid-right" method of use shown in FIG. 9, with the co-axis of the inner portions held toward the right side of the user's torso. The methodology is generally the same as that of the vertical mid-left method of FIG. 8, except that the apparatus 10 is held toward the right side of the user's torso.

Figure 10:
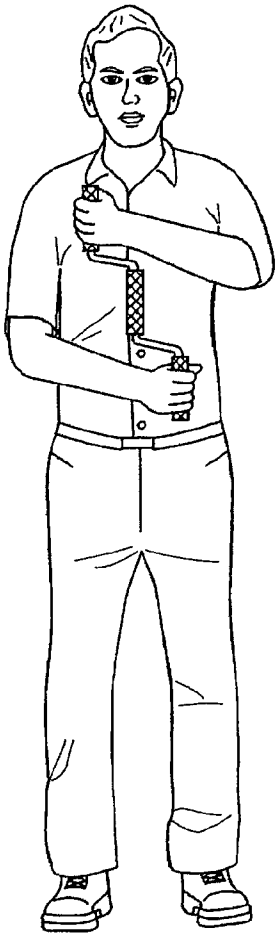
FIG. 10 is a front view of a user in a position to operate a pedal-configured apparatus to practice a "vertical mid-center" method of the present invention.

FIG. 10 shows the user practicing a similar "vertical mid-center" method of use. The methodology is generally the same as that of the vertical mid-left method of FIG. 8 and the vertical mid-right method of FIG. 9, except that the apparatus 10 is held at about the center of the user's torso.

Figure 9:
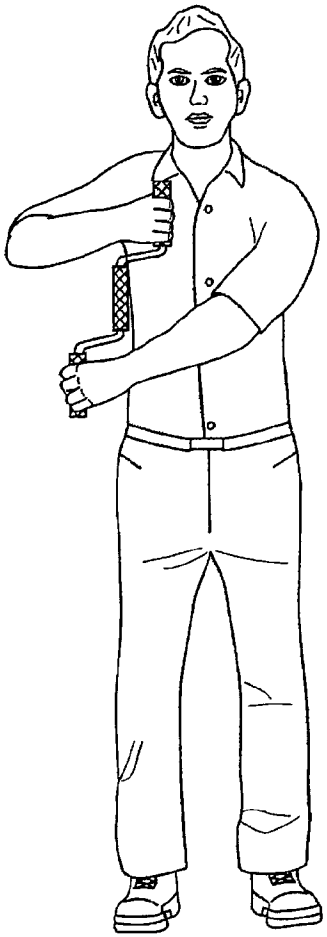
FIG. 9 is a front view of a user in a position to operate a pedal-configured apparatus to practice a "vertical mid-right" method of the present invention.

It is understood that the user can practice the methods of FIGS. 8-10 with either hand, right or left, being the "upper" hand and the other the "lower" hand. (The user's right hand is the upper hand in FIGS. 8-10, but the method includes the inverse, whereby the user's left hand is upper.) One hand is above the other, and the method includes having the left hand grip the upper end of the apparatus 10. Moreover, it is to be understood that the user can reverse hand positions (left for right) during an exercise session, alternating left hand and right hand as the upper hand.

It again is to be recognized that the user may practice these vertically oriented methods with his palms/wrists facing either forward (away from the user's torso) or backward (toward the user's torso). The user's grasp upon either or both grips 30 and/or 32 can be with the palm(s)/wrist(s) facing outward or inward. In FIG. 8, for example, the right hand is in a palm-out position, while the left hand is in a palm-in position. In FIGS. 9 and 10, both hands are in the palm-in position. During the practice of the methods, either hand can be in either type of position to grasp the respective grips 30, 32 of the apparatus. The position of the user's hands upon the grips of the apparatus affects the character of the user's grasp and the motions of her arms, altering the character of her muscular activity and broadening the workout. The type of grasp (out-facing or in-facing) can be changed or alternated during a workout session, and for either or both hands.

The method of the invention includes moving the apparatus 10 amongst and between the various spatial positions seen in FIGS. 8-10. The user, while continuously pedaling the apparatus and substantially maintaining the verticality of the co-axis of the inner portions 20, 24, may move the apparatus 10 in front of her torso in a side-to-side manner. While the revolving of the outer portions 18, 26 is continued, the user can translate the apparatus alternately between the vertical mid-left position (FIG. 8) and the vertical mid-right position (FIG. 10), or between any number of intermediate lateral side-to-side positions.

The vertically oriented usages of the apparatus seen in FIGS. 8-10 works on the both internal and external rotation of both the user's shoulders, each in two different planes.

The method of the invention also includes using the apparatus 10 while it is assembled in the U-shaped "crank configuration" seen in FIG. 4. The apparatus 10 in the crank configuration generally is used in a front-and-center spatial position as suggested by FIG. 11. The user can utilize the apparatus 10 in the crank configuration in either a solo mode or with the assistance of a therapist or assistant. The user may be sitting or standing.

Figure 11:
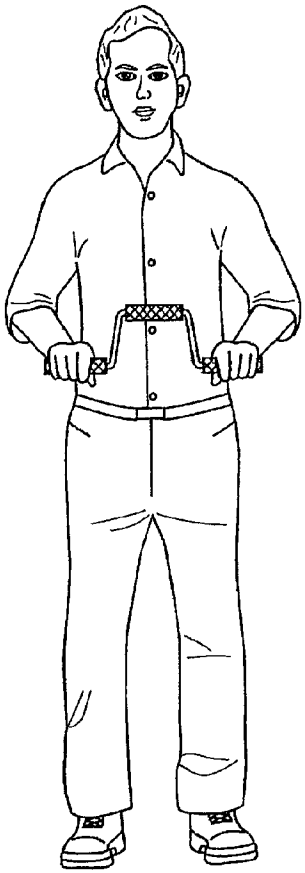
FIG. 11 is a front view of a user in a position to operate a crank-configured apparatus to practice an alternative method of the present invention.

Whether the user is alone or accompanied by a second person such as a therapist, the method involves the user executing a cranking or rowing type of motion. In this rowing motion, the coaxially aligned outer portions 18, 26 of the apparatus 10 revolve around the central co-axis defined by the conjoined inner portions 20, 24. This arrangement is seen in FIG. 11.

When the user is accompanied and assisted by a second person, the rowing action involves steadily holding the conjoined inner portions 20, 24 at a substantially fixed position in 3-D space while the user moves the outer portions 18, 26 about the immobile axis of revolution defined by the inner portions. Attention is invited to FIG. 12 in this regard. In the method, the second person (e.g., therapist) firmly grasps the middle hand grip 31 on the base inner portion 20 of the apparatus, and holds the apparatus as steadily as possible so as to maintain the axis of rotation 45 at a generally fixed position in space. (The axis of rotation 45 ordinarily is oriented horizontally as seen in the figure, but alternatively may be oriented vertically.) The user grasps the grips 30, 32 in his left and right hands, and cranks or "rows" the apparatus 10 by moving the co-axis of the outer portions 18 and 26 around the axis of revolution 45 as indicated by the directional arrow in FIG. 12. Of course, the direction of revolution can be either forward or backward, and the user can alternately reverse the direction of revolution during a therapeutic session. The therapist occasionally during a therapy session can relocate in 3-D space (or in relation to the user) the position or orientation of the apparatus's axis of revolution 45. This method well-works the user's shoulder joint and shoulder girdle.

Figure 13:
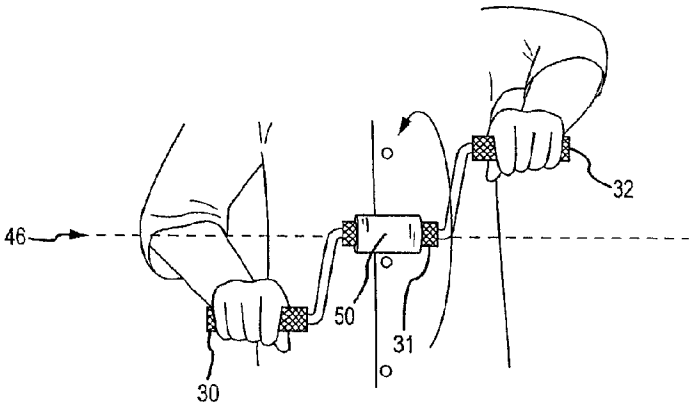
FIG. 13 is a front view of a portion of a user in a position to operate a pedal-configured apparatus to practice an alternative method of the present invention, in which a weighted cuff or sling is disposed or hung upon a center portion of the apparatus during the practice of the invention.

FIG. 13 shows a mode for practicing the invention by a solo user manipulating the apparatus 10 in the pedal configuration. In this version of the method, one or more interchangeable ballast weights 50 of selected weight are attached to or suspended from the middle hand grip 31 of the base inner portion 20. The suspension can be by any appropriate means, such as by placing a conventional cuff weight around and on the middle hand grip 31, or alternatively by disposing a fabric sling assembly around the base inner portion 20 so to hang down with one or ballast weights 50 in or on the sling.

A preferred version of the solo-operator mode of FIG. 13 features an axis of revolution 46 defined by the axes of the conjoined inner portions 20, 24 of the apparatus 10 in the pedal configuration. To practice the solo method of FIG. 13, the user holds her arms out in front of her (preferably but not strictly necessarily straight out (i.e. horizontally)), and pivots her arms up and down to revolve the outer portions 18, 26 of the apparatus so to cause the inner portions 20, 24 (with the ballast weight 50 thereupon) to rotate around the axis 46, as suggested by the directional arrow of FIG. 13. The weight 50 helps mildly to stabilize the apparatus in motion. Moreover and importantly, the weight force is against gravity, thus amplifying the exercise of the user's upper extremities as she holds the apparatus in position in front of her body (preferably with arms substantially parallel to the floor). The user must exercise many muscles of the arms and shoulder to maintain the position and motion of the apparatus 10 about the axis 46; the exercise is particularly effective if the user holds her arms in a straight horizontal position.

It is noted that the apparatus 10 can be used to practice a method in which the apparatus is configured in the pedal configuration (FIG. 3), but practiced by two persons, such as a patient and therapist. In this version of the method, there is no placement of a weight 50 on the mid hand grip 31; rather, the middle hand grip 31 of the apparatus (in the pedal position) is grasped by the therapist (in the manner indicated by FIG. 12). The user-patient can thus "pedal" the apparatus in the manner suggested by FIG. 13, but with the second person's grasp lending stability to the position and operation.

Figure 12:
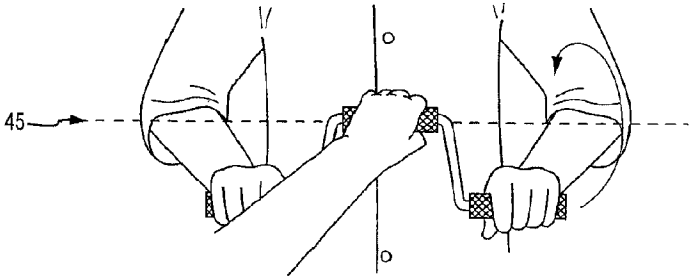
FIG. 12 is a front view of a portion of a user in a position to operate a crank-configured apparatus to practice an alternative method of the present invention, in which a second person, such as a therapist, manually grasps and holds a center portion of the apparatus during the practice of the invention.

The angled relations between the intermediate portions 22 and 28 of the apparatus 10 and the respective inner portions 20, 24 and outer portions 18, 26 facilitate the practice of the methods of the invention illustrated by FIGS. 11-13. When the apparatus 10 is in either the U-shaped crank configuration or the zigzag pedal configuration, the configuration having the angle $\alpha$ promotes the practice of the invention by two persons. The angle $\alpha$, as described and explained hereinabove, removes laterally the right and left outer hand grips 30 and 32 a modest distance away from the mid hand grip 31. This provides a clearance for the presence of the therapist's lower arm and hand—a clearance not provided when there is a right angle of ninety degrees defined by the intersections of the inner and outer portions of the base portion 12 and extension portion 14 with their respective intermediate portions 22 and 28. This is an advantage over many known "bike" type exercisers.

Figure 14:
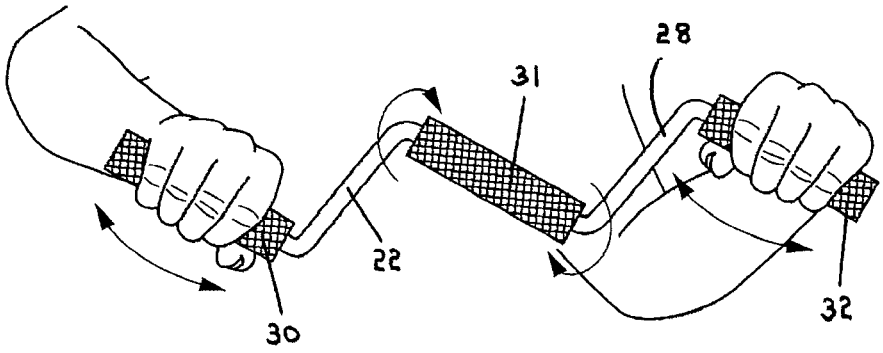
FIG. 14 is a front view of a portion of a user in a position to operate a pedal-configured apparatus to practice an alternative method of the present invention.

Attention is advanced to FIG. 14, depicting a specialized method of use in which the apparatus remains in the pedal configuration. The apparatus 10 is held in the user's hands at a tilted or angled position, with the co-axis of the inner portions 20, 24 skewed relative to both the vertical and the horizontal. The user, while grasping the two outer grips 30, 32, counter-pivots his wrists relative to each other in a pivoting wobbling-like manner to cause the conjoined inner portions 20, 24 of the apparatus to simultaneously pitch and yaw. The user's knuckles bob to and fro, as suggested by the directional arrows in FIG. 14. The activity results in the opposite ends of the base inner portion 20 to revolve in two generally circular paths, as also indicated by directional arrows in FIG. 14. The user can execute this sort of eccentric rotary motion in ether a backward (clockwise) or forward (counterclockwise) direction, but the exercise can be executed by most individuals only while the hands/fists are in a palms-down position as seen in the figure. Propelling the apparatus 10 in this manner, primarily with wrist action, especially while periodically reversing and re-reversing the direction of rotation, improves wrist flexion and extension, as well as radial and ulnar flexion and extension. Further, propelling the apparatus in this mode also works on pronation and supination of the forearms at the radioulnar joint. Lower arm muscle groups are unconventionally exercised.

From the foregoing, methods according to the invention are apparent to persons skilled in the art. In sum, there is provided one possible preferred method for exercising a person's upper body and/or extremities comprising the steps of: (a) providing an apparatus 10 comprising: a base portion 12 comprising: an inner base portion 20; a middle hand grip 31 rotatably disposed on the inner base portion 20; an outer base portion 18; a left hand grip 30 rotatably disposed on the outer base portion; and an intermediate base portion 22 connecting the outer base portion to the inner base portion and defining an angle with the inner base portion; (b) an extension portion 14 releasably connectable to the base portion 12, the extension portion comprising: an inner extension portion 24; an outer extension portion 26; a right hand grip 32 rotatably disposed on the outer extension portion; and an intermediate extension portion 28 connecting the outer extension portion to the inner extension portion and defining an angle with the inner extension portion; and, in a preferred embodiment, (c) releasably connecting the base portion to the extension portion.

The method preferably further comprising selectively mutually releasably connecting the base portion 12 and the extension portion 14 in either a generally zig-zag-shaped pedal configuration (FIG. 3) or a generally u-shaped crank configuration (FIG. 4), wherein: (a) the step of releasably connecting the base portion and the extension portion in the pedal configuration (FIG. 3) comprises coaxially aligning and connecting the inner base portion 20 and the inner extension portion 24 to define a central co-axis, and such that an axis of the outer base portion 18 and an axis of the outer extension portion 26 are parallel and offset so not to be coaxially aligned; and (b) releasably connecting the base portion 12 and the extension portion 14 in the crank configuration (FIG. 4) comprises coaxially aligning and connecting the inner base portion 20 and the inner extension portion 24 to define a central co-axis, and such that the axis of the outer base portion and the axis of the outer extension portion are parallel and are coaxially aligned.

The method preferably includes the steps of releasably connecting the base portion 12 and the extension portion 14 in the pedal configuration; grasping the left hand grip 30; grasping the right hand grip 32; and revolving the respectively offset axes of the base outer portion 18 and of the extension outer portion 26 around the central co-axis of the inner portions 20, 24. The method includes holding generally horizontal the central co-axis defined by the inner portions 20, 24. The method also contemplates the moving of the central co-axis through different positions in 3-D space. The method may also include maintaining the central co-axis at substantially a single position in 3-D space for a selected interval of time.

A ballast weight 50 may be attached or suspended at the base inner portion.

The method may include the step of holding the central co-axis (defined by the joined inner portions) at about the height of the user's chest, or at about the height of the user's face, or at about the height of the user's chest.

Rather than holding the central co-axis horizontal, the method may include the step of holding generally vertical the central co-axis. With the co-axis so held, the method may include moving the central co-axis through different positions in 3-D space. Or, the central co-axis may be maintained at substantially a single position in 3-D space for a selected interval of time. The method accordingly may also include the steps of holding the central co-axis toward the left side of the user's torso, or holding the central co-axis at about the center of the user's torso, or holding the central co-axis toward the right side of the user's torso.

An alternative mode of the method may include the steps of: (a) holding the central co-axis at an angled position in 3-D space with the co-axis of the inner portions 20, 24 skewed relative to both the vertical and the horizontal (FIG. 14); and while grasping the two outer grips 30, 32; (b) counter-pivoting the user's wrists relative to each other in a pivoting manner to cause the connected inner portions to simultaneously pitch and yaw, and the opposite ends of the base inner portion 20 to revolve in two generally circular paths.

When the apparatus 10 has two dis-connectable portions, the base portion 12 and the extension portion 14, method may also include the steps of: (a) releasably connecting the base portion and the extension portion in the crank configuration (FIG. 12); (b) a first user grasping the left hand grip 30; (c) the first user grasping the right hand grip 32; and (c) revolving the aligned axes of the base outer portion 18 and of the extension outer portion 26 around an axis of rotation 45 defined by the central co-axis of the inner portions 20, 24. In such use, the method optionally may include the step of a second user grasping the middle hand grip 31.

Accordingly, there has been provided a versatile and very portable apparatus, and related methods, for promoting exercise, including physically therapeutic exercise, of a user's upper body or upper extremities. By using the disclosed apparatus 10 to practice the disclosed exercise methods, at least all the following types of upper body motions can be exercised and improved: Elbow flexion; wrist extension; wrist flexion, radial and ulnar flexion; lower arm pronation and supination; shoulder joint flexion and extension; shoulder joint external and internal rotation; shoulder joint horizontal abduction and horizontal adduction; shoulder girdle abduction and adduction; and shoulder girdle upward and downward rotation.

Although the invention has been described in detail with particular reference to these preferred embodiments, other embodiments can achieve the same results. And while the present invention has been particularly illustrated and described with reference to exemplary embodiments thereof, it will be understood by those of ordinary skill in the art that various changes in form and details may be made therein without departing from the spirit and scope of the present invention as defined by the appended claims. Therefore, it is to be understood that the above-described exemplary embodiments have been provided only in a descriptive sense and will not be construed as placing any limitation on the scope of the invention. Variations and modifications of the present invention will be obvious to those skilled in the art and it is intended to cover in the appended claims all such modifications and equivalents.

I claim:

1. A method for exercising a person's upper extremities comprising:

providing an apparatus comprising:

a base portion comprising:

an inner base portion;

a middle hand grip rotatably disposed on the inner base portion;

an outer base portion;

a left hand grip rotatably disposed on the outer base portion; and an intermediate base portion connecting the outer base portion to the inner base portion and defining an angle with the inner base portion;

an extension portion releasably connectable to the base portion, the extension portion comprising:

an inner extension portion;

an outer extension portion;

a right hand grip rotatably disposed on the outer extension portion; and an intermediate extension portion connecting the outer extension portion to the inner extension portion and defining an angle with the inner extension portion;

releasably connecting the base portion to the extension portion;

selectively mutually releasably connecting the base portion and the extension portion in either a generally zig-zag-shaped pedal configuration or a generally u-shaped crank configuration, wherein:

releasably connecting the base portion and the extension portion in the pedal configuration comprises coaxially aligning and connecting the inner base portion and the inner extension portion to define a central co-axis, and such that an axis of the outer base portion and an axis of the outer extension portion are parallel and offset so not to be coaxially aligned; and releasably connecting the base portion and the extension portion in the crank configuration comprises coaxially aligning and connecting the inner base portion and the inner extension portion to define a central co-axis, and such that the axis of the outer base portion and the axis of the outer extension portion are parallel and are coaxially aligned;

a first user grasping the left hand grip;

the first user grasping the right hand grip;

a second user grasping the middle hand grip; and revolving the axes of the base outer portion and of the extension outer portion around an axis of rotation defined by the central co-axis of the inner portions.

2. The method of claim 1 further comprising holding generally horizontal the central co-axis.

3. The method of claim 2 further comprising maintaining the central co-axis at substantially a single position in space for a selected interval of time.

4. The method of claim 3 further comprising attaching a ballast weight at the base inner portion.

5. The method of claim 3 further comprising holding the central co-axis at the height of the user's chest.

6. The method of claim 3 further comprising holding the central co-axis at the height of the user's face.

7. The method of claim 1 further comprising holding generally vertical the central co-axis.

8. The method of claim 7 further comprising maintaining the central co-axis at substantially a single position in space for a selected interval of time.

9. The method of claim 8 further comprising holding the central co-axis toward the left side of the user's torso.

10. The method of claim 8 further comprising holding the central co-axis at the center of the user's torso.

11. The method of claim 8 further comprising holding the central co-axis toward the user's right side.

12. The method of claim 1 further comprising:

holding the central co-axis at an angled position in space with the co-axis of the inner portions skewed relative to both the vertical and the horizontal;

while grasping the two outer grips, counter-pivoting the user's wrists relative to each other in a pivoting manner to cause the connected inner portions to simultaneously pitch and yaw, and the opposite ends of the base inner portion to revolve in two generally circular paths.

13. An apparatus for exercising a person's upper body consisting of:

a base portion comprising:

an inner base portion;

a middle hand grip rotatably disposed on the inner base portion;

an outer base portion;

a left hand grip rotatably disposed on the outer base portion; and an intermediate base portion connecting the outer base portion to the inner base portion and defining an angle with the inner base portion; and an extension portion connectable to the base portion, the extension portion comprising:

an inner extension portion;

an outer extension portion;

a right hand grip rotatably disposed on the outer extension portion; and an intermediate extension portion connecting the outer extension portion to the inner extension portion and defining an angle with the inner extension portion; and means for releasably connecting the base portion to the extension portion;

wherein the means for releasably connecting the base portion to the extension portion comprises a spring-biased button, on either the inner extension portion or the inner base portion, and releasably engagable in a corresponding connection hole in either the inner base portion or the inner extension portion, respectively.

* * * * *